US008714524B2

(12) United States Patent
Bacon

(10) Patent No.: US 8,714,524 B2
(45) Date of Patent: May 6, 2014

(54) BELT-DRIVEN TRANSPORTATION SYSTEM

(75) Inventor: Todd J. Bacon, Northville, MI (US)

(73) Assignee: Herkules Equipment Corporation, Walled Lake, MI (US)

( * ) Notice: Subject to any disclaimer, the term of this patent is extended or adjusted under 35 U.S.C. 154(b) by 512 days.

(21) Appl. No.: 12/912,548

(22) Filed: Oct. 26, 2010

(65) Prior Publication Data

US 2011/0139549 A1 Jun. 16, 2011

Related U.S. Application Data

(63) Continuation-in-part of application No. 12/639,632, filed on Dec. 16, 2009.

(51) Int. Cl.
*B66F 3/22* (2006.01)
*B66F 3/00* (2006.01)
*B66B 9/02* (2006.01)

(52) U.S. Cl.
USPC ..... 254/122; 254/126; 254/124; 187/269

(58) Field of Classification Search
USPC ..... 254/122, 126, 124, 338; 269/131; 187/269
See application file for complete search history.

(56) References Cited

U.S. PATENT DOCUMENTS

| | | | | |
|---|---|---|---|---|
| 1,991,255 | A | | 2/1935 | Martin |
| 3,006,382 | A | * | 10/1961 | Broome ..... 139/84 |
| 3,901,356 | A | | 8/1975 | Butler |
| 4,219,186 | A | | 8/1980 | Brewer |
| 4,427,093 | A | | 1/1984 | Wehmeyer et al. |
| 4,534,544 | A | | 8/1985 | Heide |
| 4,577,821 | A | | 3/1986 | Edmo et al. |
| 4,619,346 | A | | 10/1986 | Deguerry |
| 4,858,482 | A | | 8/1989 | Knudsen |
| 4,872,800 | A | | 10/1989 | Gutov et al. |
| 4,899,987 | A | | 2/1990 | Craig |
| 4,905,496 | A | | 3/1990 | Venalainen |
| 4,921,074 | A | | 5/1990 | Ochs |
| 5,149,242 | A | | 9/1992 | Haymore |
| 5,299,906 | A | | 4/1994 | Stone |
| 5,322,143 | A | | 6/1994 | Curran |
| 5,513,723 | A | | 5/1996 | Luebke |
| 5,636,711 | A | | 6/1997 | Nussbaum |
| 5,695,173 | A | | 12/1997 | Ochoa et al. |
| 5,722,513 | A | | 3/1998 | Rowan et al. |
| 5,934,414 | A | | 8/1999 | Staczek |

(Continued)

FOREIGN PATENT DOCUMENTS

EP 0501254 A2 2/1992

OTHER PUBLICATIONS

English language translation of Abstract for European Patent Application No. 0501254A2, filed Feb. 28, 1991.

*Primary Examiner* — Lee D Wilson
*Assistant Examiner* — Seahee Yoon
(74) *Attorney, Agent, or Firm* — Howard & Howard Attorneys PLLC

(57) ABSTRACT

A belt-driven transportation system including a first set of pulleys rotatably attached to a first member and a second set of pulleys rotatably attached to a second member. The first and second members have relative movement to each other. The system further includes a unitary belt that is guided through a path defined by the first and second sets of pulleys. A plurality of flange members maintain a proper positioning of the belt on the pulleys.

21 Claims, 15 Drawing Sheets

(56) References Cited

U.S. PATENT DOCUMENTS

| | | | |
|---|---|---|---|
| 6,092,788 | A | 7/2000 | Simon |
| 6,257,372 | B1 | 7/2001 | Schirmer |
| 6,286,629 | B1 | 9/2001 | Saunders |
| 6,305,499 | B1 | 10/2001 | Jones et al. |
| 6,371,247 | B1 | 4/2002 | Nedderman, Jr. |
| 6,464,205 | B2 | 10/2002 | Wanner |
| 6,537,017 | B2 | 3/2003 | Stone |
| 6,591,945 | B1 | 7/2003 | Kigawa et al. |
| 6,601,826 | B1 | 8/2003 | Grannata |
| 6,619,433 | B1 | 9/2003 | Robert et al. |
| 6,634,462 | B2 | 10/2003 | Byeong-Ho |
| 6,640,934 | B1 | 11/2003 | Edwards |
| 6,672,430 | B2 | 1/2004 | Boucher et al. |
| 6,679,479 | B1 | 1/2004 | Watkins |
| 6,705,238 | B1 | 3/2004 | Heckert |
| 6,742,768 | B2 | 6/2004 | Alba |
| 6,779,635 | B1 | 8/2004 | Anibas |
| 6,814,188 | B1 | 11/2004 | Heckert |
| 6,854,715 | B2 | 2/2005 | Hicks et al. |
| 7,070,167 | B1 | 7/2006 | Bacon et al. |
| 7,117,977 | B2 | 10/2006 | Abe |
| 7,213,686 | B2 | 5/2007 | Kaufman |
| 7,225,901 | B2 | 6/2007 | Mustalahti et al. |
| 7,331,425 | B2 | 2/2008 | Bukowski et al. |
| 7,383,923 | B2 | 6/2008 | Patten et al. |
| 7,413,056 | B2 | 8/2008 | Gonzi et al. |
| 7,461,722 | B2 | 12/2008 | Kyotani |
| 7,506,725 | B2 | 3/2009 | Kuo et al. |
| 2006/0037518 | A1 | 2/2006 | Lopez Alba |
| 2006/0169543 | A1* | 8/2006 | Gonzi et al. ..... 187/269 |
| 2007/0213154 | A1* | 9/2007 | Broyan ..... 474/148 |

* cited by examiner

BELT-DRIVEN TRANSPORTATION SYSTEM

CROSS-REFERENCE TO RELATED APPLICATIONS

The subject patent application is a continuation-in-part of U.S. patent application Ser. No. 12/639,632, filed on Dec. 16, 2009, which is now U.S. Pat. No. 8,662,477, the disclosure(s) of which is/are hereby incorporated by reference.

BACKGROUND OF THE INVENTION

1. Field of the Invention

The present invention relates generally to belt-driven transportation systems, and particularly to such systems configured as lift assemblies and conveyor assemblies.

2. Description of the Related Art

Transportation systems such as lift assemblies are well known for moving items or people between two vertically differing locations. Transportation systems such as conveyor assemblies are well known for moving items or people between two horizontally differing locations. It is also known to move the platform or carriage of these systems through a belt-driven apparatus.

One well-known and useful type of lift assembly is the scissor-type, which moves between a lowered or contracted state, and an elevated or extended state as its load-supporting platform is moved between differing vertical locations. Such lift assemblies are commonly driven through hydraulic cylinders, screw-drive mechanisms or expandable pneumatic bladder arrangements, and some prior types of scissor lift assemblies are belt-driven. These prior lift assemblies, however, often require a substantial amount of power, particularly when moving from their lowermost contracted states, or are difficult to reliably, precisely control.

Further, some prior belt-driven transportation systems can be problematic to install or repair, and sometimes to operate, due to the belt being moved out of its guided position along its designed path over pulleys that it engages. Another problem with some types of belt-driven transportation systems is that they rely on traction between the belt and the pulleys to operate, which can lead to slippage under heavy loading and result in unintentional lift collapse. Additionally, some transportation systems of the types described above, particularly lift assemblies, undesirably require operating space that cannot be easily accommodated or interferes with carrying out the operation to which the system is applied. For example, some prior lift assemblies have platform heights in their fully contracted states that require the load to first be lifted a substantial vertical distance from the level of a floor, on which the base is positioned, to place it on the platform. Thus, it would be preferable to minimize the height of the platform in its fully contracted or lowered state.

A transportation system configured as a lift assembly or conveyor assembly that addresses at least one of the above-mentioned problems is desirable.

SUMMARY OF THE INVENTION

The present invention provides a scissors-type lift assembly including a base and a platform. The platform is coupled to the base for movement between elevated and lowered states in which the platform and the base are distant and proximate, respectively. A pair of first and second scissor arms each have upper and lower ends, respectively, which are coupled to the platform and the base. The pair of scissor arms pivotably connect to each other intermediate their respective upper and lower ends about a central pivot axis. A first pulley arrangement has a plurality of first pulleys disposed about a first pulley shaft defining a first pulley axis. A second pulley arrangement has a plurality of second pulleys disposed about a second pulley shaft defining a second pulley axis with the first and second pulley axes disposed in a pulley plane and having lateral movement relative to each other as the lift assembly is moved between its the elevated and lowered states. A spool is rotatable about an axis fixed to the base. A unitary belt is guided through a path defined by the first and second pulleys with the belt having a first end engaged with the spool onto which the belt is wound and from which the belt is unwound and an opposing second end. The first pulley arrangement further includes a plurality of independently rotatable first flange members disposed about the first pulley shaft with at least one of the first flange members disposed between each of the first pulleys to sandwich the respective first pulleys and to maintain the belt on the path about the respective first pulleys. Similarly, the second pulley arrangement further includes a plurality of independently rotatable second flange members disposed about the second pulley shaft with at least one of the second flange members disposed between each of the second pulleys to sandwich the respective second pulleys and to maintain the belt on the path about the respective second pulleys.

There has thus been outlined, rather broadly, certain features of embodiments of the invention in order that the detailed descriptions thereof may be better understood, and in order that the present contribution to the art may be better appreciated. Additional or alternative features of embodiments of the invention are described in further detail below.

In this respect, before explaining embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

To accomplish the above and related objects, the invention may be embodied in the forms illustrated in the accompanying drawings, attention being called to the fact, however, that the drawings are illustrative only, and that changes may be made in the specific constructions illustrated. Moreover, it is to be noted that the accompanying drawings are not necessarily drawn to scale or to the same scale. In particular, the scale of some of the elements of the drawings may be exaggerated to emphasize characteristics of the elements.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views.

Figure 1:
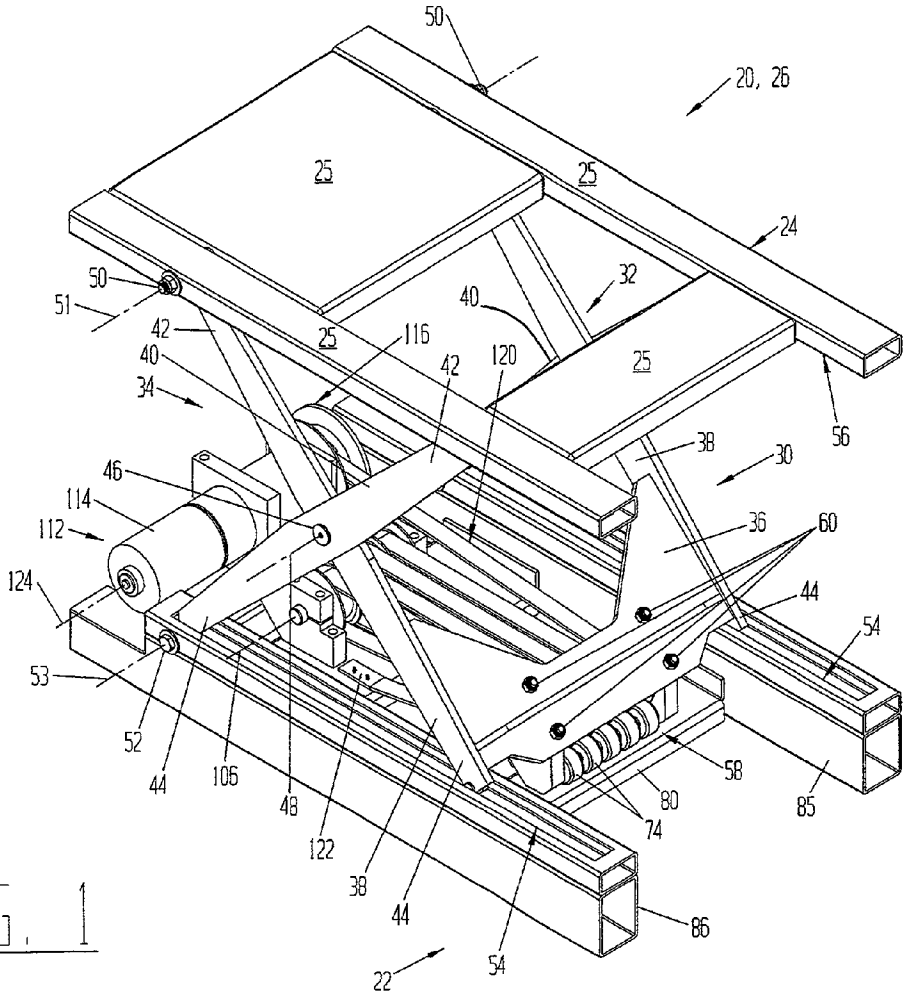
FIG. 1 is a perspective view of a scissor-type lift assembly according to a first embodiment in an elevated state.

While the invention is susceptible to various modifications and alternative forms, specific embodiments thereof are shown by way of example in the drawings and may herein be described in detail. It should be understood, however, that the drawings and detailed description thereto are not intended to limit the invention to the particular forms disclosed, but on the contrary, the intention is to cover all modifications, equivalents and alternatives falling within the spirit and scope of the present invention as defined by the appended claims.

DETAILED DESCRIPTION

Figure 2:
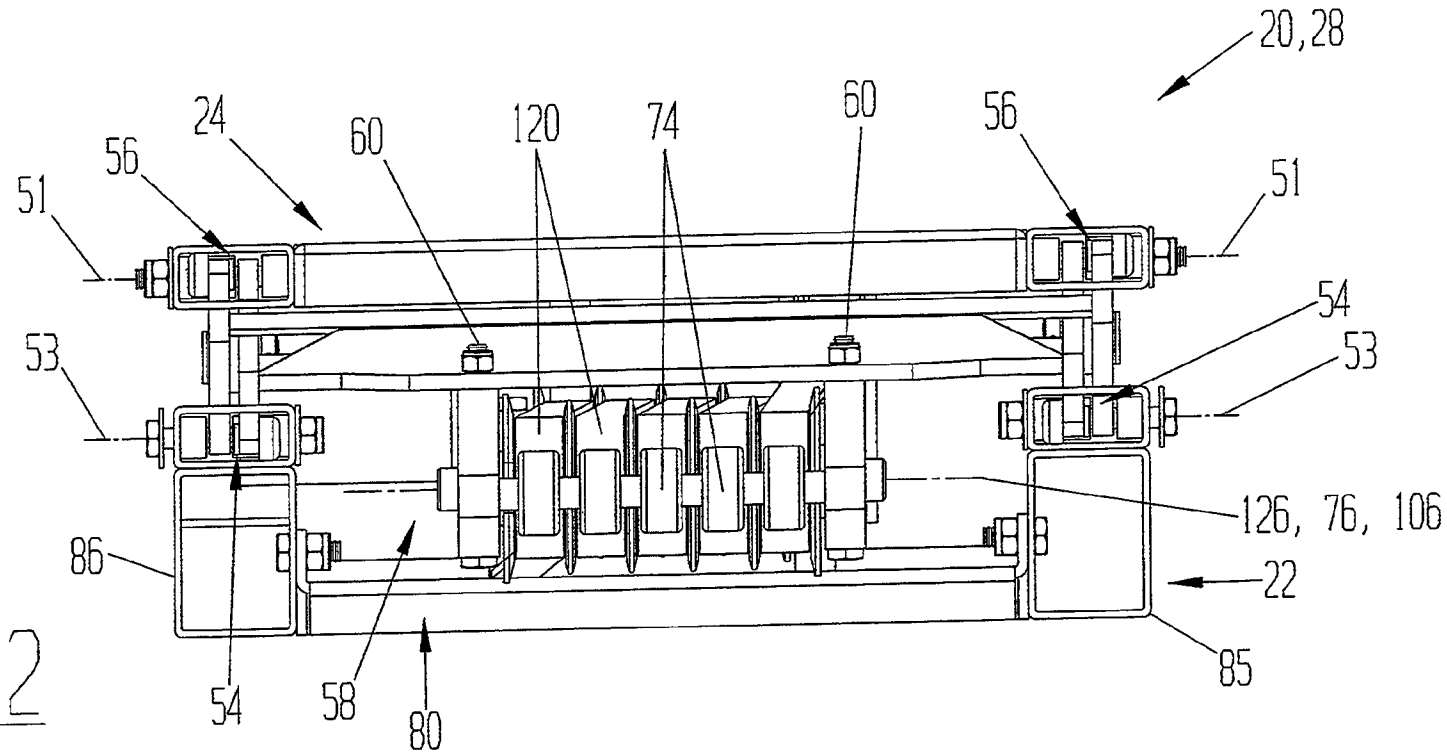
FIG. 2 is a front view of the lift assembly shown in FIG. 1 in a lowered state.
Figure 3:
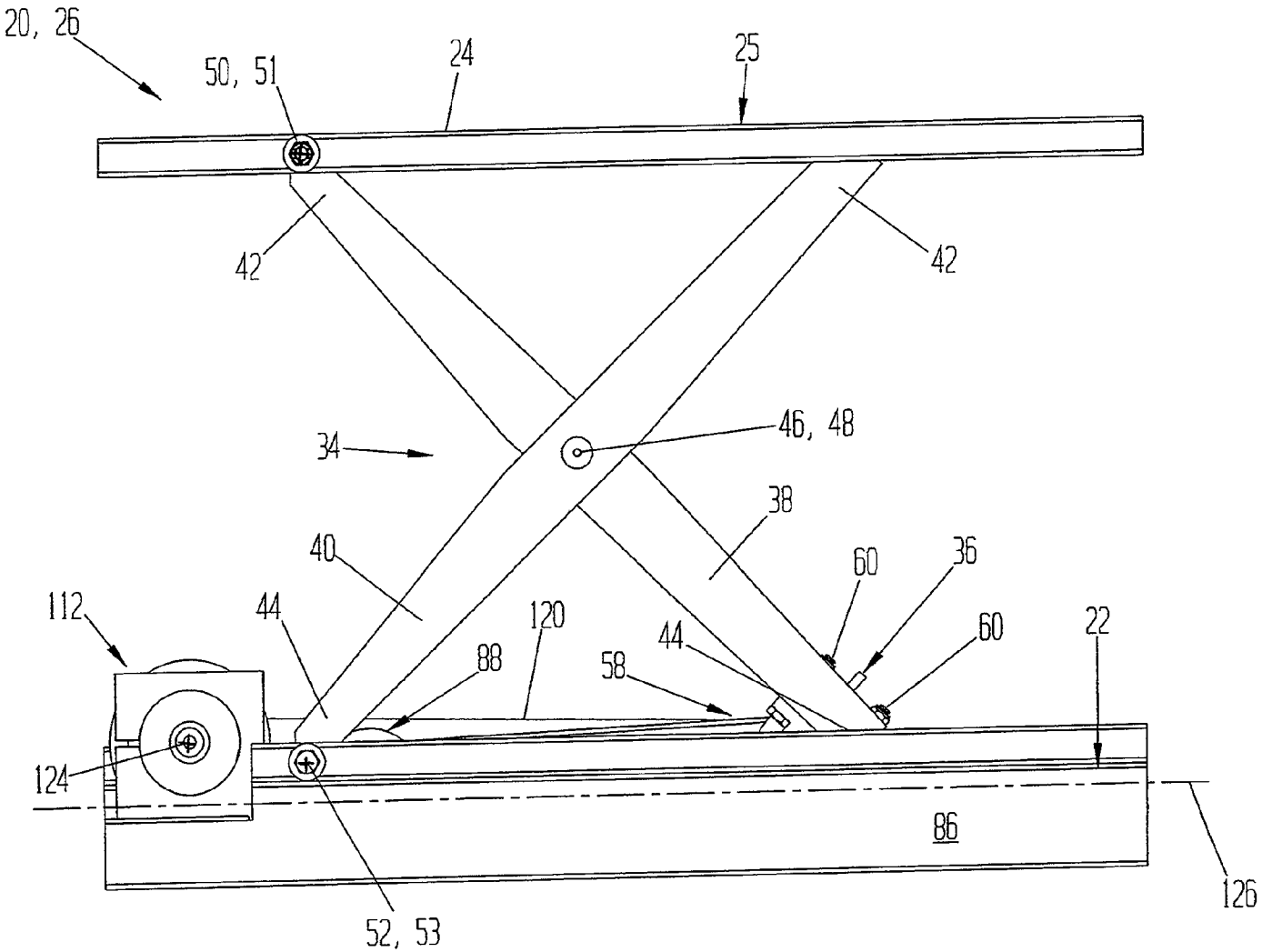
FIG. 3 is a side view of the lift assembly shown in FIG. 1 in an elevated state.
Figure 4:
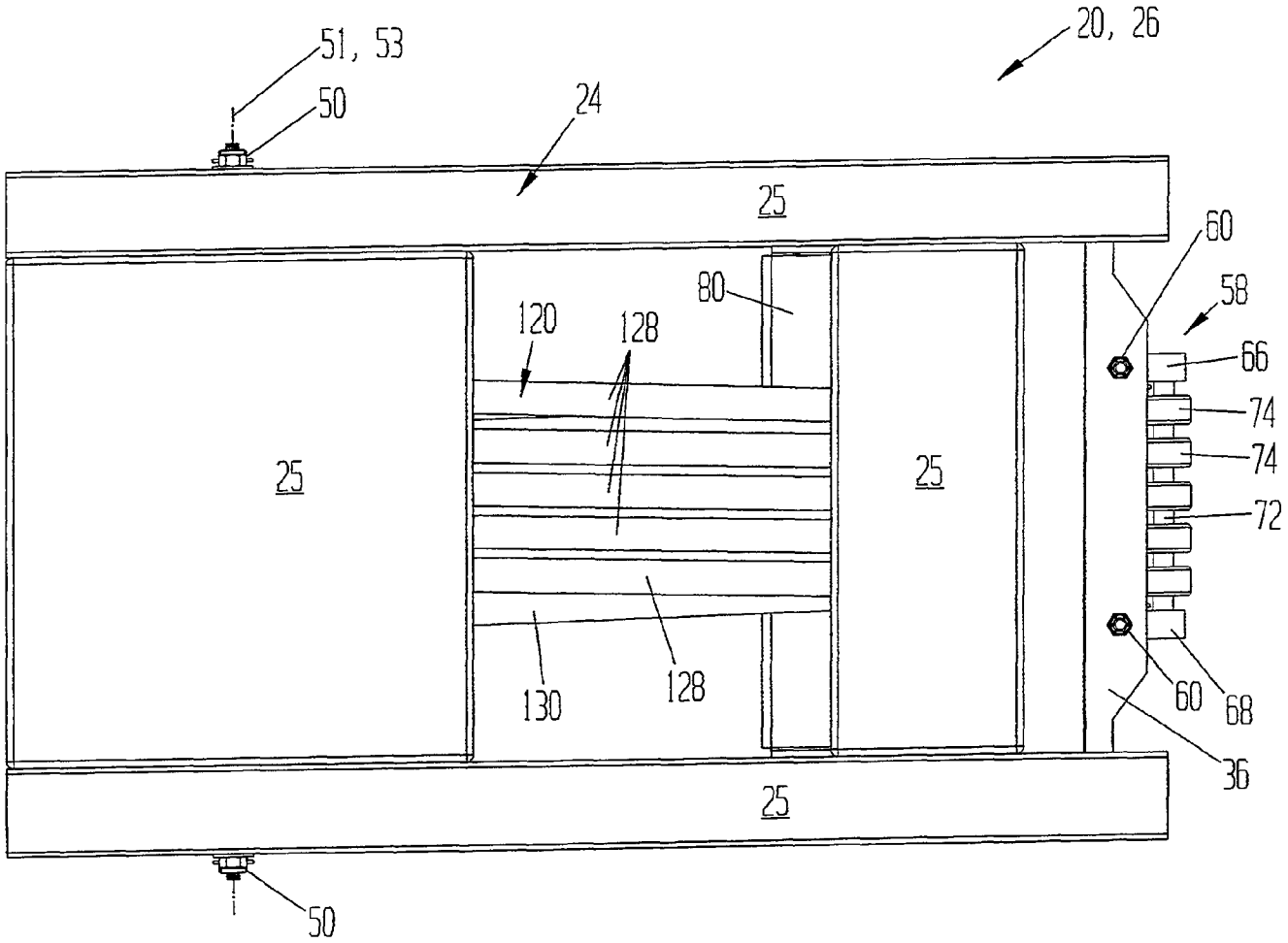
FIG. 4 is a top view of the lift assembly shown in FIG. 1 in a lowered state.
Figure 5:
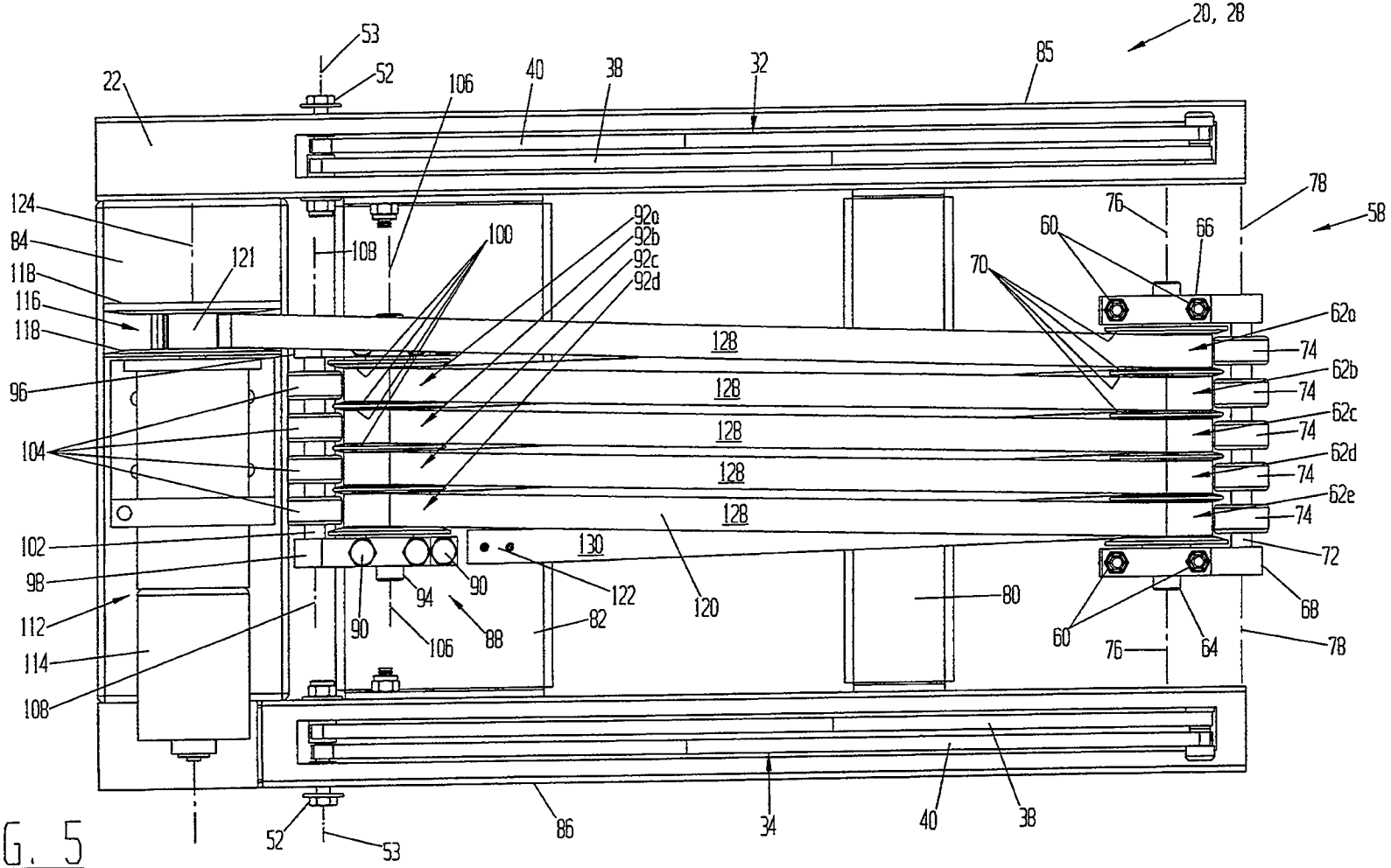
FIG. 5 is a top view of the lift assembly shown in FIG. 1 in a lowered state with its platform removed from view.

Referring FIGS. 1-5 there is show first embodiment scissor-type lift assembly 20 which has a base 22 and a platform 24, each of which may be made of steel. Platform 24 has upwardly facing supporting surfaces 25. Lift assembly 20 has an elevated state 26 in which the platform and base are distant from each other, and a lowered state 28 in which the lift assembly base and platform are proximal to each other. FIGS. 1 and 3 show lift assembly 20 in elevated state 26, and FIGS. 2, 4 and 5 show lift assembly 20 in lowered state 28.

Disposed between and operatively connected to base 22 and platform 24 is scissor arm assembly 30 which includes first pair of scissor arms 32 and second pair of scissor arms 34. Between the first and second pair of scissor arms is brace 36, which extends between first arm 38 of each of the first and second pairs of scissor arms 32, 34. The first and second pairs of scissor arms 32 and 34 each further includes second arm 40. Arms 38, 40 may be made of steel. Upper end 42 of each first and second arm 38, 40 engages platform 24, and lower end 44 of each first and second arm 38, 40 engages base 22. Respective to each pair of scissor arms 32, 34, first and second arms 38, 40 are pivotably connected to each other through a bolted connection 46 about pivot axis 48 of scissor arm assembly 30.

Each first arm 38 has a bolted connection 50 to platform 24, which defines pivot axis 51, and each second arm 40 has a bolted connection 52 to base 22, which defines pivot axis 53. Base 22 includes guide tracks 54 in which lower ends 44 of the first arms 38 are slidably engaged, and platform 24 includes guide tracks 56 in which upper ends 42 of second arms 40 are slidably engaged.

Lift assembly 20 further includes first pulley arrangement 58 which is connected to brace 36 with bolts 60. First pulley arrangement 58 includes a plurality of pulleys 62. Five pulleys 62, identified as pulleys 62*a* through 62*e* in FIG. 5, are independently rotatable about shaft 64, which extends between and is fixed to laterally spaced blocks or support members 66 and 68, into which bolts 60 are threadedly received. Blocks 66, 68 may be made of steel.

Adjacent pulleys 62 may have therebetween a bushing or other friction reducing member to facilitate their independent rotation relative to each other about the shaft 64. Flange members 70 are disposed between each of the pulleys 62 which defines a belt engaging circumferential pulley surface 330 discussed further below in connection with FIG. 12.

The first pulley arrangement 58 further includes a shaft 72 that is parallel with the shaft 64, and about which are disposed independently rotatable retainer rollers 74, one for each of the pulleys 62. The shaft 72 also extends between and is fixed to laterally spaced blocks or support members 66 and 68. Thus, the pulleys 62 and retainer rollers 74 are respectively rotatable about parallel axes of rotation 76 and 78 respectively defined by the shafts 64 and 72. It is thus understood that the first pulley arrangement 58 moves relative to the base 22 with the first scissor arms 38 as the lift assembly 20 is moved between its elevated and lowered states 26, 28.

The base 22 includes laterally extending cross braces 80, 82, and 84 which extend between and are fixed to its opposite rails 85, 86. Attached to cross brace 82 is second pulley arrangement 88, which is fixed to base 22 by means of bolts 90. Second pulley arrangement 88 includes a plurality of pulleys 92. Four pulleys 92, identified as pulleys 92*a* through 92*d* in FIG. 5, are independently rotatable about shaft 94, which extends between and is fixed to laterally spaced blocks or support members 96 and 98, into which bolts 90 are threadedly received.

Adjacent pulleys 92 may have therebetween a bushing or other friction reducing member to facilitate their independent rotation relative to each other about the shaft 94. Flange members 100 are disposed between each of the pulleys 92 which defines a belt engaging circumferential pulley surface 330 discussed further below in connection with FIG. 12.

The second pulley arrangement 88 further includes the shaft 102 that is parallel with the shaft 94, and about which are disposed independently rotatable retainer rollers 104, one for each of the pulleys 92. The shaft 102 also extends between and is fixed to laterally spaced blocks or support members 96 and 98. Thus, the pulleys 92 and retainer rollers 104 are respectively rotatable about parallel axes of rotation 106 and 108 respectively defined by the shafts 94 and 102.

The lift assembly 20 further includes a motor drive assembly 112, which includes a reversible servo or stepper motor 114, which is in driving, co-axial engagement with a spool or pulley 116, which has opposed flanges 118 between which is defined a belt engaging portion. A unitary belt 120 having opposite first and second ends 121, 122 is guided along a path defined by the pulleys 62 and 92, and a first end 121 of belt 120 is connected to the spool 116 such that rotation of the spool 116 about its axis of rotation 124 will either wind the belt 120 onto the spool or unwind the belt 120 from the spool 116. A spool axis of rotation 124 is substantially parallel with the pulley axes 76 and 106.

A plane 126 is defined by the pulley axes 76 and 106, and maintains a substantially horizontal orientation, parallel with the platform surfaces 25. As best seen in FIG. 3, the plane 126 is disposed within the height defined by the base 22. The first and second pulley arrangements 58, 88 move toward and away from each other in the plane 126 as the lift assembly 20 is moved between its elevated and lowered states 26, 28. Relative to lift assembly 20, the plane 126 is stationary in this embodiment.

Figure 11:
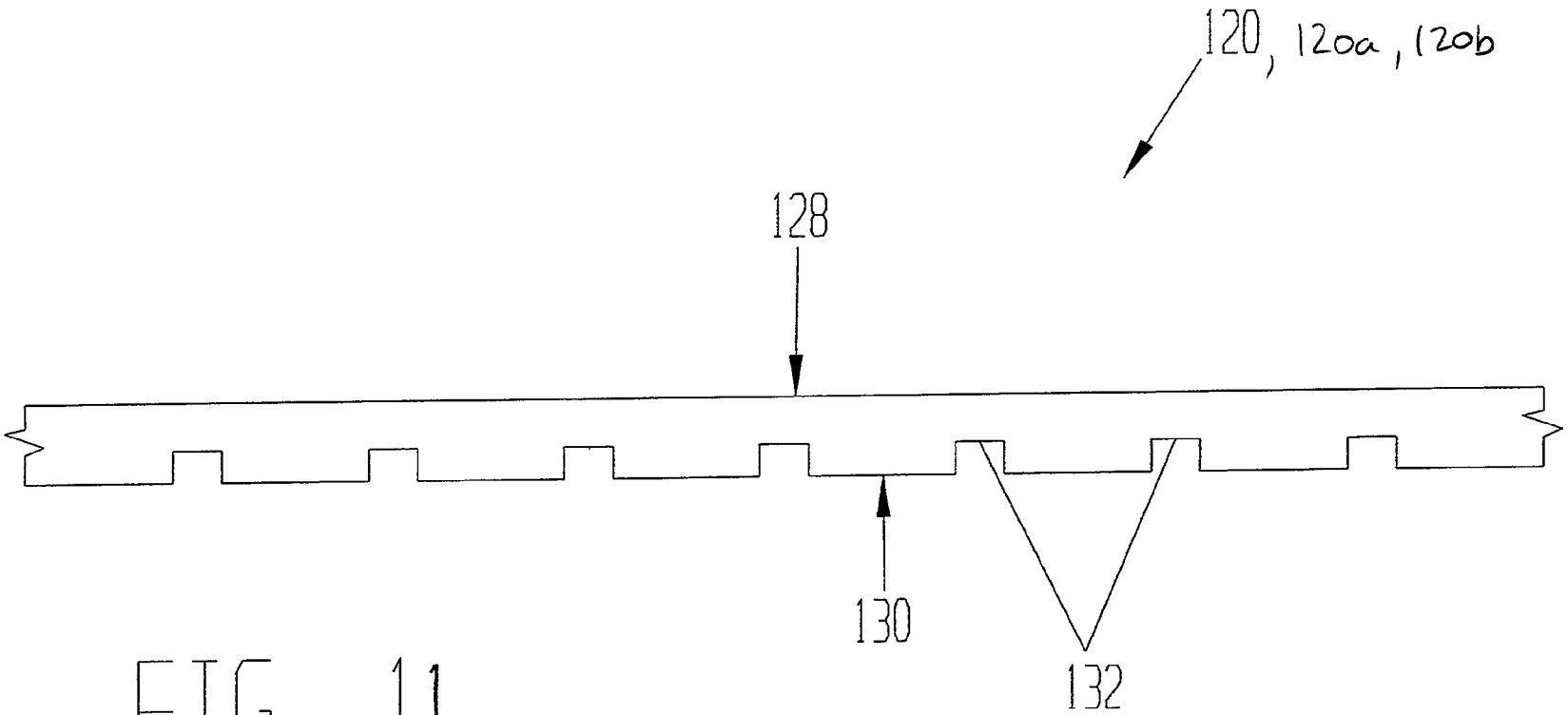
FIG. 11 is a fragmented side view of a unitary belt used with any of the embodiments.

Referring now to FIG. 11, it can be seen that the belt 120 is substantially flat and has an outer side 128 and an opposite inner side 130. The inner side 130 is provided with a plurality of longitudinally spaced and laterally extending grooves 132 which define ribs on the inner side 130 of the belt 120, thereby facilitating the belt's ability to wrap itself about the pulleys and the spool. The belt 120 can be any of a number of commercially available belts of suitable width, length and material properties that may be selected based on the requirements of the application for which lift assembly 20 is to be used.

Referring to FIG. 5, the elongate unitary belt 120 extends from about the spool 116 rightwardly to the first pulley arrangement 58 where it is wrapped about the pulley 62*a*, and from the pulley 62*a* the belt 120 reverses course and at a slight return angle returns toward the second pulley arrangement 88 where it is then wrapped about the pulley 92*a*. From the pulley 92*a* the belt 120 reverses course and at a slight return angle returns toward the first pulley arrangement 58 where it is wrapped about the pulley 62*b*. From the pulley 62*b* the belt 120 reverses course and at a slight return angle returns toward the second pulley arrangement 88 where it is wrapped about the pulley 92*b*. From the pulley 92*b* the belt 120 reverses course and at a slight return angle returns toward the first pulley arrangement 58 where it is wrapped about the pulley 62*c*. From the pulley 62*c* the belt 120 reverses course and at a slight return angle returns toward the second pulley arrangement 88 where it is wrapped about the pulley 92*c*. From the pulley 92*c* the belt 120 reverses course and at a slight return angle returns toward the first pulley arrangement 58 where it is wrapped about the pulley 62*d*. From the pulley 62*d* the belt 120 reverses course and at a slight return angle returns toward the second pulley arrangement 88 where it is wrapped about the pulley 92*d*. From the pulley 92*d* the belt 120 returns in a direction toward the first pulley arrangement 58 and wraps about the pulley 62*e*, and reverses course returning toward the second pulley arrangement 88 and its second end 122 is affixed to the cross brace 82 of the base 22. The return angle along which belt 120 extends between the first and second pulley arrangements 58, 88 is relative to their parallel pulley axes 76, 106, and will vary slightly as the lift assembly 20 moves between its elevated state 26 in which the return angle is at a maximum, and its lowered state 28 in which the return angle is at a minimum. The belt's ability to accommodate the return angles is facilitated in part by the belt engaging circumferential pulley surface 330 of the pulleys 62 and 92.

One of ordinary skill in the art will recognize that first pulley arrangement 58, which is attached by its blocks 66 and 68 to scissor arm assembly 30, is biased rightwardly as shown in FIG. 5 and away from second pulley arrangement 88 which is affixed to base 22, to maintain an amount of tension on belt 120. The first and second pulley arrangements 58, 88 are biased apart from each other under the weight of scissor arm assembly 30, platform 24, and any load on the platform. Thus, axes 76, 106 are biased laterally apart from each other in plane 126. Pulleys 92 and pulley 62 may be of a common diameter, and thus the lengths of belt 120 extending therebetween on opposite sides of plane 126 respectively lay in common planes parallel to plane 126.

As belt 120 is wound onto spool 116, the length of the path along which belt 120 is guided about pulley 62 and 92 becomes shortened, and axes 106 and 76 are moved laterally within plane 126 towards one another as the lower ends 44 of first arms 38 are moved leftwardly towards lower ends 44 of second arms 44, thereby changing the angle at which the elongate first and second arms 38, 40 are crossed, and platform 24 is moved upwardly towards its elevated state 26.

Conversely, as belt 120 is unwound from about spool 116, the weight of scissor arm assembly 30, platform 24, and any load it bears, urges scissor arm assembly 30 towards a collapsed state, in which the angle at which the elongate first and second scissor arms 38, 40 are crossed changes such that first pulley arrangement 58 is moved rightwardly away from second pulley arrangement 88, and lift assembly 20 is moved towards its lowered state 28.

Referring now to FIGS. 6-12, there is shown a second embodiment of the scissor-type lift assembly 20A, which is similar in some respects to the first embodiment of the scissor lift assembly 20 such that corresponding components are provided with common reference numerals.

The scissor lift assembly 20A includes a motor drive assembly 112 in which a reversible servo or stepper motor 114 is oriented along a drive axis 134 that is substantially perpendicular to a spool drive axis 124. The output shaft of motor 114 extends into a gear drive unit in which the spool driving output shaft that defines axis 124 extends laterally in opposite directions from the gear drive housing. Each laterally extending end of the output shaft has a spool 116 affixed thereto. In other words, there are two spools 116 rotatable about the spool drive axis 124 with one on each side of the output shaft.

Figure 6:
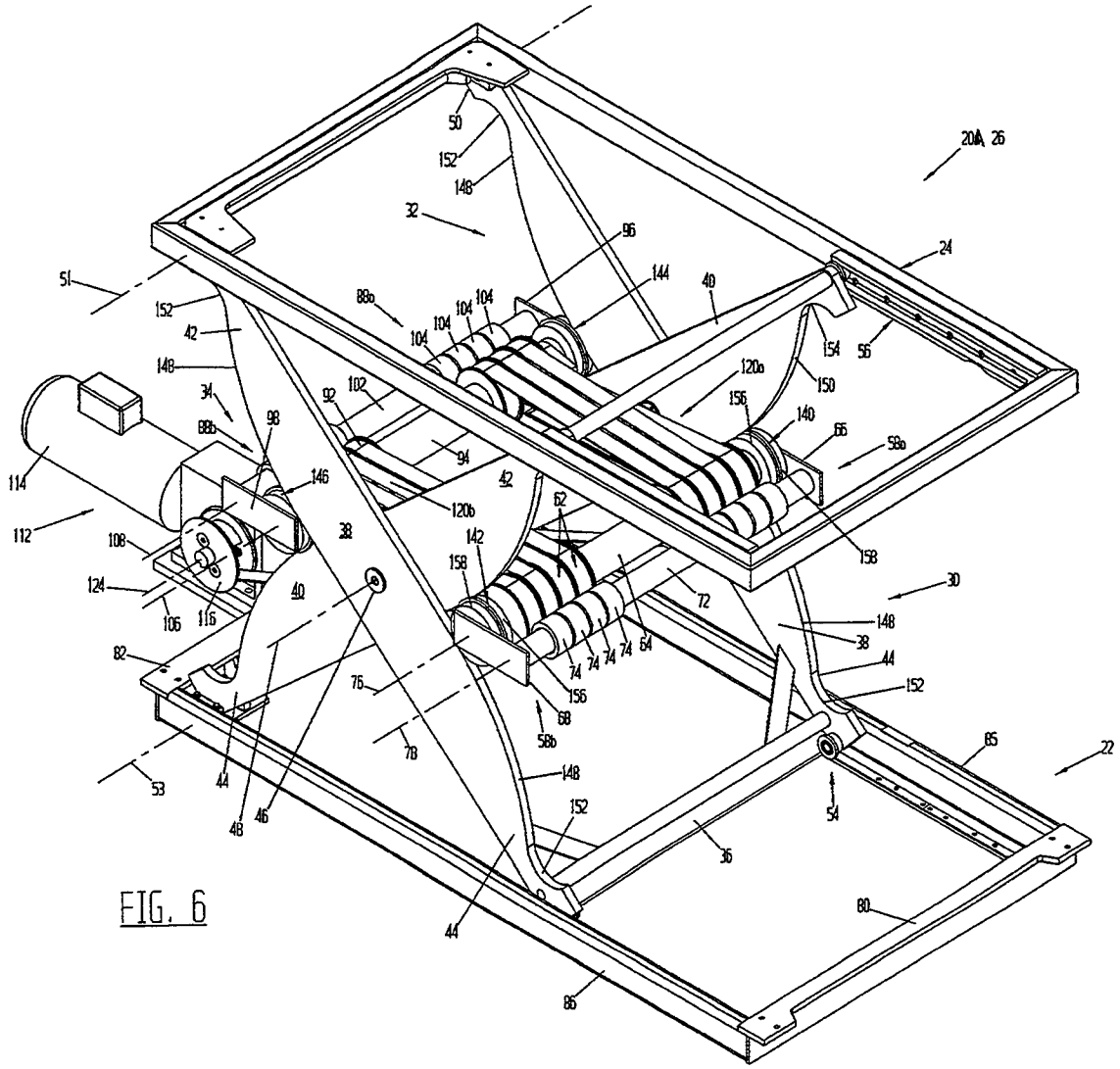
FIG. 6 is a perspective view of a scissor-type lift assembly according to a second embodiment in an elevated state.
Figure 7:
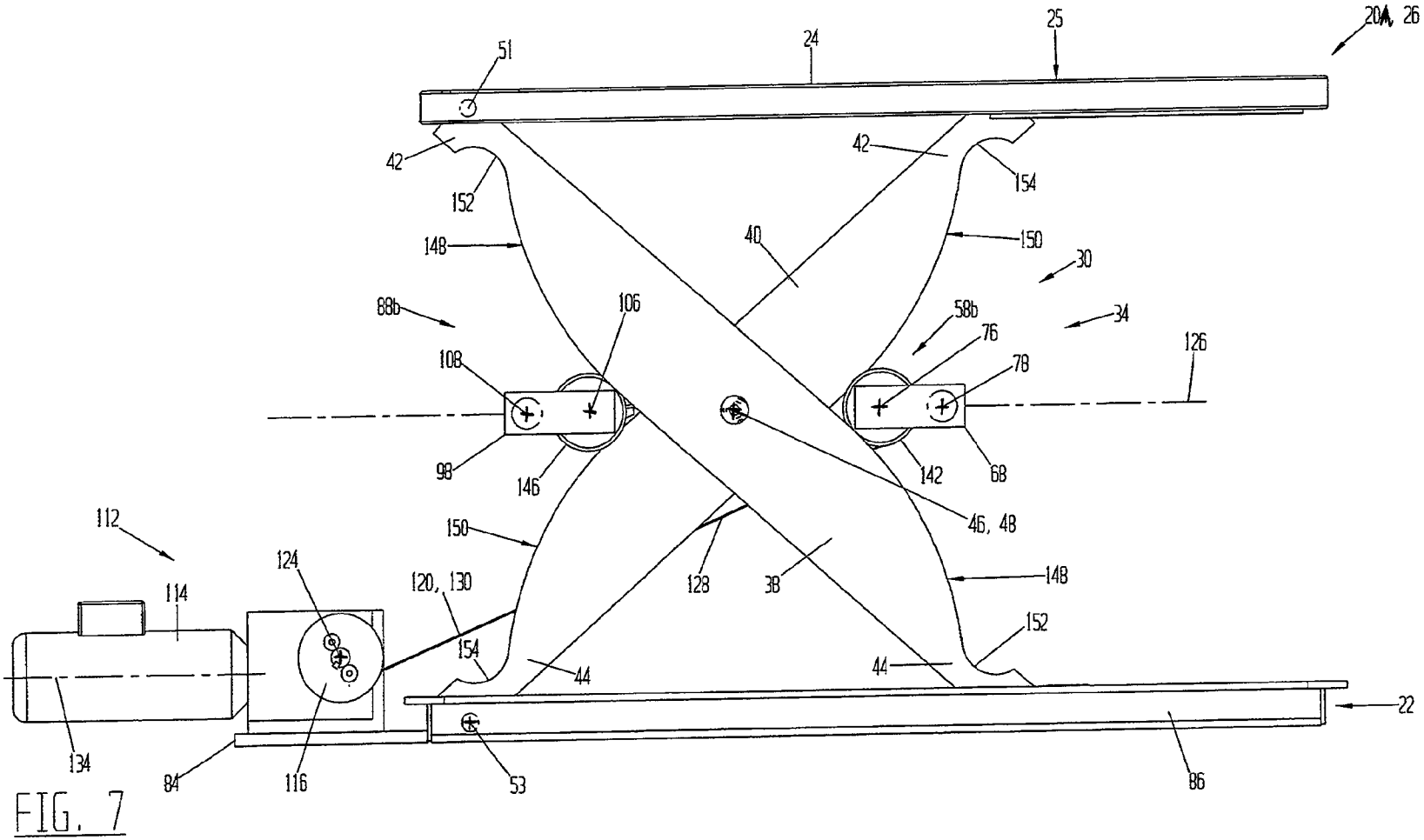
FIG. 7 is a side view of the lift assembly shown in FIG. 6 in an elevated state.
Figure 10:
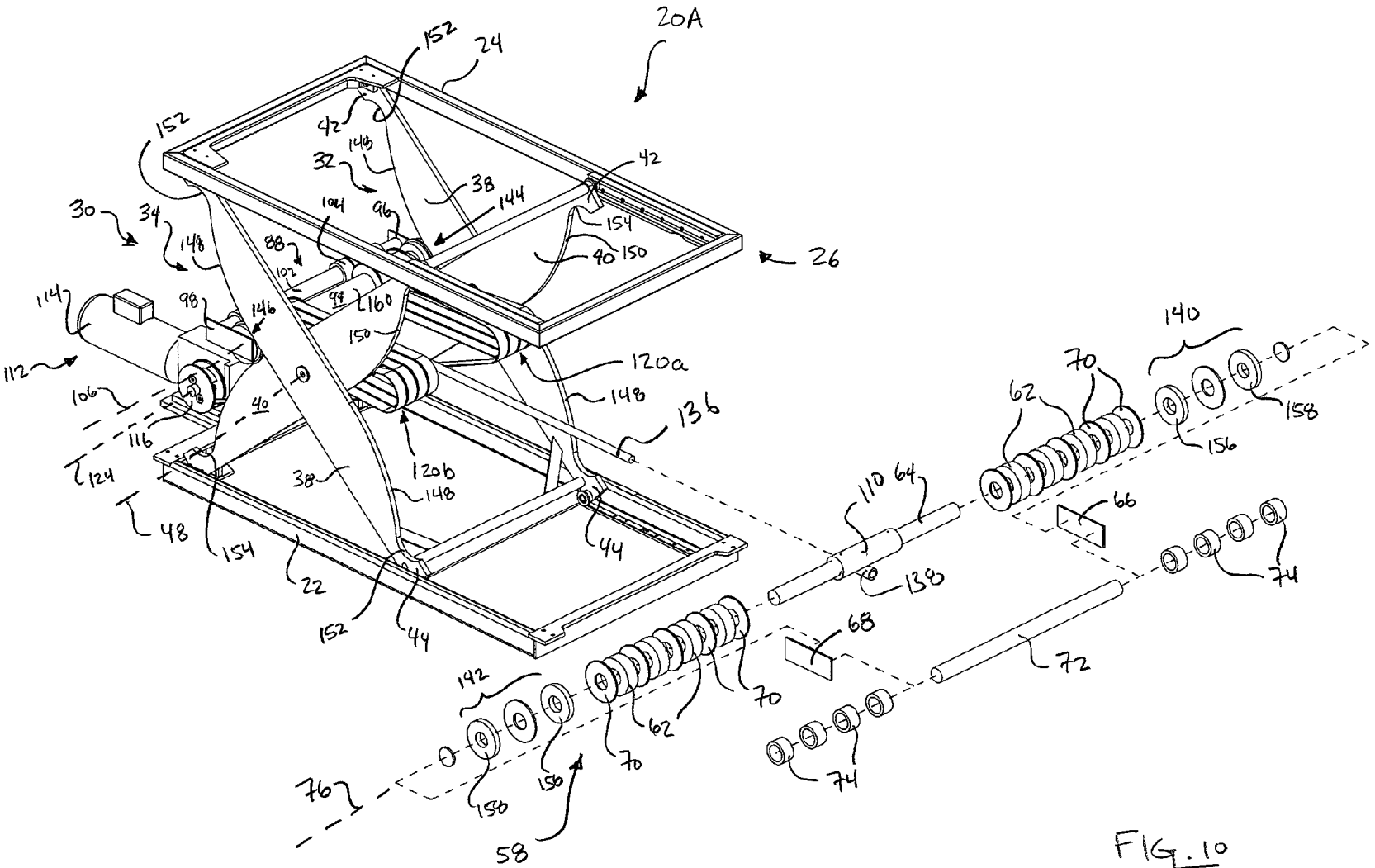
FIG. 10 is a partially exploded view of the lift assembly shown in FIG. 6 in an elevated state.

As best shown in FIGS. 6 and 10, the lift assembly 20A includes a unitary belt 120*a*, 120*b*. In particular, the unitary belt includes a pair of first and second drive belts 120*a*, 120*b*, which work in parallel. In other words, the unitary belt is further defined as a first drive belt 120*a* and further including a second drive belt 120*b* to define a dual-belt configuration. One of the spools 116 is dedicated to the first drive belt 120*a* and the other spool 116 is dedicated to the second drive belt 120*b*. The two drive belts 120*a*, 120*b* can provide a measure of safety beyond the single belt arrangement shown in the first embodiment of the lift assembly 20. The depicted dual-belt configuration of the lift assembly 20A protects the user and the lifted load from injury or damage due to failure of one of the drive belts 120*a* and 120*b*. It is to be understood that the first embodiment of the lift assembly 20 may be outfitted with a dual belt drive like that shown in the second embodiment of the scissor lift assembly 20A. Conversely, the second embodiment of the scissor lift assembly 20A may be outfitted with a single belt drive like that shown in the first embodiment of the lift assembly 20.

In the second embodiment of the scissor lift assembly 20A, the first and second pulley arrangements 58, 88 are disposed between the first and second scissor arms 38, 40 of the first and second pairs of scissor arms 32, 34. The first and second pairs of scissor arms 32, 34 each have upper 42 and lower 44 ends respectively coupled to the platform 24 and the base 22 as discussed in greater detail above. The pair of scissor arms 32, 34 are pivotably connected to each other intermediate their respective upper 42 and lower 44 ends about a central pivot axis 48. As with the first embodiment, the platform 24 of this embodiment is coupled to the base 22 for movement between elevated and lowered states in which the platform 24 and the base 22 are distant and proximate, respectively.

The first pulley arrangement 58 includes a pulley arrangement 58*a* associated with the first drive belt 120*a* and another pulley arrangement 58*b* associated with the second drive belt 120*b*. Each first pulley arrangement 58*a* and 58*b* has a plurality of first pulleys 62 that are independently rotatably disposed on a common first pulley shaft 64 extending between and fixed to laterally spaced blocks or support members 66 and 68. The first pulley shaft 64 defines a first pulley axis 76 about which the first pulleys 62 rotate. The first plurality of pulleys 62 includes two groups of first pulleys 62 spaced from each other with one of the groups supporting the first drive belt 120*a* and the other of the group supporting the second drive belt 120*b*. The separation of the two groups may be performed in any suitable manner. As illustrated, the first pulley shaft 64 includes a first spacer 110 for separating the groups of the first pulleys 62. The first spacer 110 is further defined as a centrally located enlarged section of the shaft 64.

Similarly, the second pulley arrangement 88 includes a pulley arrangement 88*a* associated with first drive belt 120*a* and another pulley arrangement 88*b* associated with second drive belt 120*b*. Each second pulley arrangement 88*a* and 88*b* has a plurality of second pulleys 92 that are independently rotatably disposed on a common second pulley shaft 94 extending between and fixed to laterally spaced blocks or support members 96 and 98. The second pulley shaft 94 defines a second pulley axis 106 about which the second pulleys 92 rotate. The first 76 and second 106 pulley axes are disposed in a pulley plane and laterally move relative to each other as the lift assembly 20A is moved between its elevated and lowered states. The second plurality of pulleys 92 includes two groups of second pulleys 92 spaced from each other with one of the groups supporting the first drive belt 120*a* and the other of the group supporting the second drive belt 120*b*. As mentioned above, the separation of the two groups may be performed in any suitable manner. As illustrated, the second pulley shaft 94 includes a second spacer 160 for separating the groups of the second pulleys 92.

The first drive belt 120*a* is guided through a path defined by the first and second pulleys with the belt 120*a* having a first end engaged with the spool 116 onto which the belt 120*a* is wound and from which the belt 120*a* is unwound. The first drive belt 120*a* also includes an opposing second end that is fixed to one of the pulley arrangements. Similarly, the second drive belt 120*b* is guided through a path defined by the first and second pulleys with the belt 120*b* having a first end engaged with another spool 116 onto which the belt 120*b* is wound and from which the belt 120*b* is unwound. The second drive belt 120*b* also includes an opposing second end that is fixed to one of the pulley arrangements.

Figure 12:
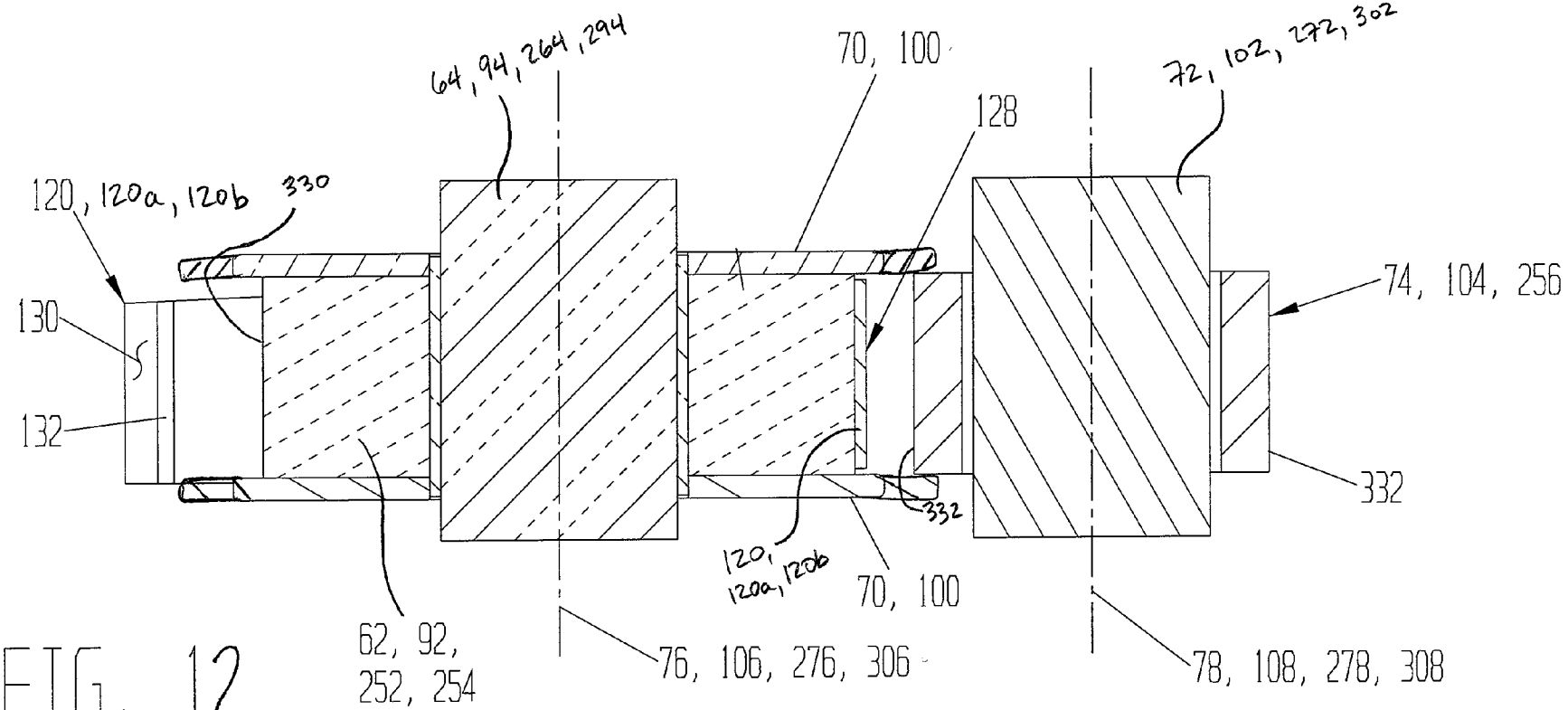
FIG. 12 is a fragmented, partially sectioned view of an exemplary pulley, retainer roller and unitary belt of any of the embodiments.

As discussed above relative to the first embodiment and as shown best in FIGS. 10 and 12, adjacent pulleys 62 may have therebetween a bushing or other friction reducing member to facilitate their independent rotation relative to each other about the shaft 64. The first pulley arrangement 58*a*, 58*b* further includes a plurality of independently rotatable first flange members 70 disposed about the first pulley shaft 64. As shown in FIG. 12, the first flange members 70 may also ride on the bushing. At least one of the first flange members 70 is disposed between each of the first pulleys 62 to sandwich the respective first pulleys 62 and to maintain the belt 120*a* on the path about the respective first pulleys 62. Similarly, the second pulley arrangement 88*a*, 88*b* further includes a plurality of independently rotatable second flange members 100 disposed about the second pulley shaft 94. At least one of the second flange members 100 is disposed between each of the second pulleys 92 to sandwich the respective second pulleys 92 and to maintain the belt 120*b* on the path about the respective second pulleys 92.

The first 70 and second 100 flange members have an annular washer-like configuration. Preferably, the first 70 and second 100 flange members include smooth outer surfaces to allow relative movement between the flange members 70, 100 and the pulleys 62, 92. The first flange members 70 are independently mounted about the first shaft 64 in between the first pulleys 62. Similarly, the second flange members 100 are independently mounted about the second shaft 94 in between the second pulleys 92. The first flange members 70 are independently rotatable relative to the first pulleys 62 and each other, and the second flange members 100 are similarly independently rotatable relative to the second pulleys 92 and each other. In other words, during operation of the lift assembly 20A, the first 70 and second 100 flange members automatically find an equilibrium state as the flange members 70, 100 are free to rotate relative to the pulleys 62, 92. The equilibrium state may be rotating in either direction at any desired speed or may be stationary or may even be a combination of the two depending on the particular dynamics occurring at the time. There may also be multiple flange members 70, 100 disposed between the pulleys 62, 92.

As shown in FIG. 10, a lateral guide 136 is mounted between the first 64 and second 94 pulley shafts to maintain the pulley plane and to guide the lateral movement of the first 58 and second 88 pulley arrangements relative to each other. In the preferred embodiment, the second pulley shaft 94 is fixedly mounted to the lateral guide 136 and the first pulley shaft 64 is slidably disposed about the lateral guide 136. As illustrated, the lateral guide 136 is configured as a straight shaft. As also illustrated, the first pulley shaft 64 includes a collar 138 slideably engaging the shaft-like structure of the lateral guide 136. It should be appreciated, that the lateral guide 136 may be of any suitable configuration.

At each of the opposite distal ends of the first pulley shaft 64, between the laterally outermost first pulleys 62 and the adjacent block 66, 68, there is provided a first cam follower or roller rotatable about the first pulley axis 76. The first cam followers 140 and 142 respectively engage cam surfaces of the first and second pairs of scissor arms 32 and 34 during movement of the lift assembly 20A. Each of the first cam followers 140, 142 include two adjacent, relatively rotatable roller elements 156, 158.

At each of the opposite distal ends of the second pulley shaft 94, between the laterally outermost second pulleys 92 and the adjacent block 96, 98, there is provided a second cam follower or roller rotatable about the second pulley axis 106. The second cam followers 144 and 146 respectively engage cam surfaces of the first and second pairs of scissor arms 32 and 34 during movement of the lift assembly 20A. Like the first cam followers 140, 142, each of the second cam follower 144, 146 includes two adjacent, relatively rotatable roller elements 156, 158.

In each of the cam followers 140, 142, 144, 146, roller element 156 is located laterally inboard of roller element 158 and is in rolling contact with an edge of a second scissor arm 40, and laterally outboard roller element 158 is in rolling contact with an edge of a first scissor arm 38. Thus, the roller elements 156, 158 of each cam follower 140, 142, 144, 146 rotate in opposite directions as they roll along their respective scissor arm edges.

Each inboard roller element 156 of a cam follower 140, 142, 144, 146 engages a cam surface 150 defined on an edge of a second scissor arm 40 of the first and second pairs of scissor arms 32, 34. Similarly, each outboard roller element 158 of a cam follower 140, 142, 144, 146 engages a cam surface 148 defined on an edge of a first scissor arm 38 of the first and second pairs of scissor arms 32, 34. The upper 42 and lower 44 ends of the first and second scissor arms each include a recess 152, 154. The cam surfaces 148, 150 extend from the central pivot axis and terminate at the respective recesses 152, 154.

The axes of rotation 76 and 106 of the first and second pulley arrangements 58, 88 lie in a plane 126, the orientation of which is maintained throughout movement of the lift assembly 20A between its elevated and lowered states. In lift assembly 20A, the plane 126 remains substantially horizontal, and also includes the pivot axis 48. Here, as opposed to the first embodiment of the lift assembly 20, the plane 126 is not fixed relative to the base 22, but rather moves vertically up and down with movement of the lift assembly 20A between its elevated and lowered states 26, 28.

The tension on the belts 120*a* and 120*b* maintains the cam followers 140, 142 and 144, 146 of the first and second pulley arrangements 58 and 88 in engagement with the surfaces 150 and 148 of the first and second arms 38 and 40 of the first and second pairs of scissor arms 32, 34. The cam surfaces 148, 150 are designed to easily facilitate an initial movement of the lift assembly 20A from its lowered state 28 to minimize additional loading on the motor 114 than would otherwise be required in the absence of the cam surfaces being so designed. As shown, the cam surfaces 148, 150 establish, in the lowered state 28, a gradual slope along which the roller elements 56, 58 are forced to roll in response to the belts 120*a*, 120*b* being wound onto their respective spools 116. The slope increases somewhat as the lift assembly 20A is moved out of its lowered state 28 and axes 96, 106 are pulled laterally toward each other in the plane 126. Once the lift assembly 20A has been moved from its initial, lowered state 28, the cam surfaces 148, 150 engaged by the followers 140, 142, 144, 146 change their slopes such that the load on the motor 114 is maintained at an approximately constant level, and an increased rate of change in height of the platform 24 results.

As best shown in FIGS. 6, 9-10 and 12, a plurality of first retention rollers 74, each having a circumferential surface 332, are disposed in proximity to a respective circumferential surface 330 of the first pulleys 62. The first retention rollers 74 are also adjacent a respective portion of the belt 120*a*, 120*b* for maintaining a position of the belt 120*a*, 120*b* on the circumferential surface 330 of the first pulleys 62. A first roller shaft 72 is mounted near the first pulley shaft 64 with the first retention rollers 74 rotatably supported on the first roller shaft 72. The support members 66, 68 interconnect the pulley shaft 64 with the roller shaft 72 to maintain a relative orientation between the shafts 64, 72.

As shown in FIG. 12, each of the first retention rollers 74 are retained axially along the first roller shaft 72 by respective first flange members 70. In other words, the first flange members 70 are large enough radially to capture the first retention rollers 74 and create a somewhat closed space between the two circumferential surfaces 330, 332 to capture the belt 120*a*, 120*b*. It should be appreciated that the relative radial size of the first flange members 70 can vary and may or may not create a closed space so long as the belt 120*a*, 120*b* is adequately retained.

Similarly, a plurality of second retention rollers 104, each having a circumferential surface 332, are disposed in proximity to a respective circumferential surface 330 of the second pulleys 92. The second retention rollers 104 are also adjacent a respective portion of the belt 120*a*, 120*b* for maintaining a position of the belt 120*a*, 120*b* on the circumferential surface 330 of the second pulleys 92. A second roller shaft 102 is mounted near the second pulley shaft 94 with the second retention rollers 104 rotatably supported on the second roller shaft 102. The support members 96, 98 interconnect the pulley shaft 94 with the roller shaft 102 to maintain a relative orientation between the shafts 94, 102.

As also shown in FIG. 12, each of the second retention rollers 104 are retained axially along the second roller shaft 102 by respective second flange members 100. As discussed above, the second flange members 70 are also large enough radially to capture the second retention rollers 74 and create a somewhat closed space between the two circumferential surfaces 330, 332 to capture the belt 120*a*, 120*b*. It should be appreciated that the relative radial size of the second flange members 70 can vary and may or may not create a closed space so long as the belt 120*a*, 120*b* is adequately retained.

Figure 15:
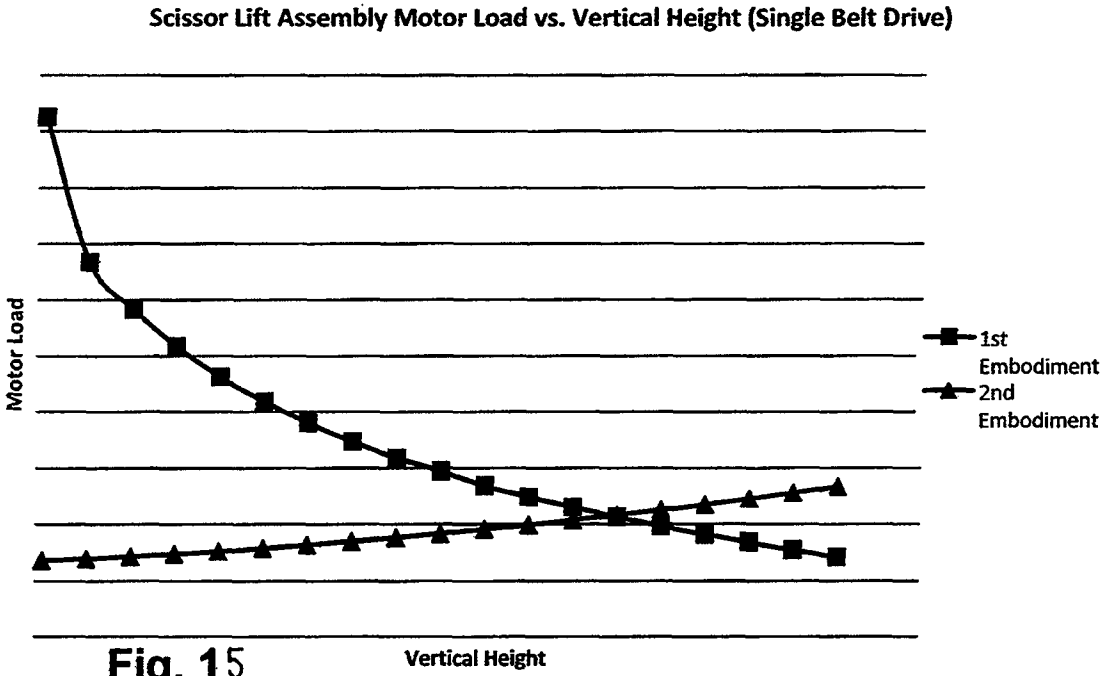
FIG. 15 is a graph comparing the motor loads of the first and second embodiments of the scissor lift assemblies (each with single belt drive) as they respectively move from their lowered to their elevated states.

FIG. 15 provides a qualitative comparison between the first embodiment of the scissor lift assembly (e.g., lift assembly 20) and an comparably sized second embodiment of the scissor lift assembly (e.g., lift assembly 20A), the latter having the cam surfaces 148, 150 substantially configured as shown in FIGS. 6-12 and described above. The first and second embodiments of the scissor lift assemblies compared through the plotted curves of FIG. 15 each have a single belt drive, as described above, and a common number of first and second pulleys 62, 92 in their respective first and second pulley arrangements 58, 88. Additionally, the comparison is through a range between lowered and elevated states that are respectively established at common platform heights, and the loads borne by their respective platforms are identical.

The motor load is derived as a function of the tension force in the segment of the belt 120 extending from about the spool 116. FIG. 15 shows, in raising the platform from the lift assembly lowered or contracted state 28 (at the left side of the graph) to the lift assembly elevated or extended state 26 (at the right side of the graph) the second embodiment scissor lift substantially reduces the motor loading vis-à-vis the first embodiment lift assembly up to a height substantially past the mid-point of platform travel, where the two lines intersect. After this height is reached, the motor load of the second embodiment of the lift assembly is comparatively higher, but not substantially so. Indeed, the second embodiment of the lift assembly motor load has only gradual, substantially linear increases as it moves from the lowered to the elevated state. On the other hand, the first embodiment of the lift assembly shows a dramatic initial reduction in motor loading immediately after moving from its lowered state, with further, more gradual and substantially linear motor load reduction occurring in the latter portions of upward platform travel towards the elevated state.

Clearly, it would be desirable to avoid the initial, comparatively much higher motor loading in moving from the lift assembly lowered state as the second embodiment lift assembly allows, for the substantially greater initial loading comes with attendant increases in energy use and stresses on the belt and other lift assembly components. However, it is contemplated that a second embodiment of the scissor lift assembly will likely have greater cost than a comparable first embodiment of the scissor lift assembly. On the other hand, the relatively flatter motor load curve of the second embodiment of the scissor lift assembly will likely reduce the need for an expensive motor control system.

Those of ordinary skill in the art will recognize that, in either of the first and second embodiments of the scissor lift assemblies, motor loading can be reduced by correspondingly increasing the number of first and second pulleys 62, 92 of the first and second pulley arrangements 58, 88 over which belt 120 is wrapped, with belt 120 being correspondingly lengthened to accommodate its increased path. This reduction in motor loading/belt tension would, however, result in comparatively slower travel between the lift assembly contracted and elevated states.

Figure 8:
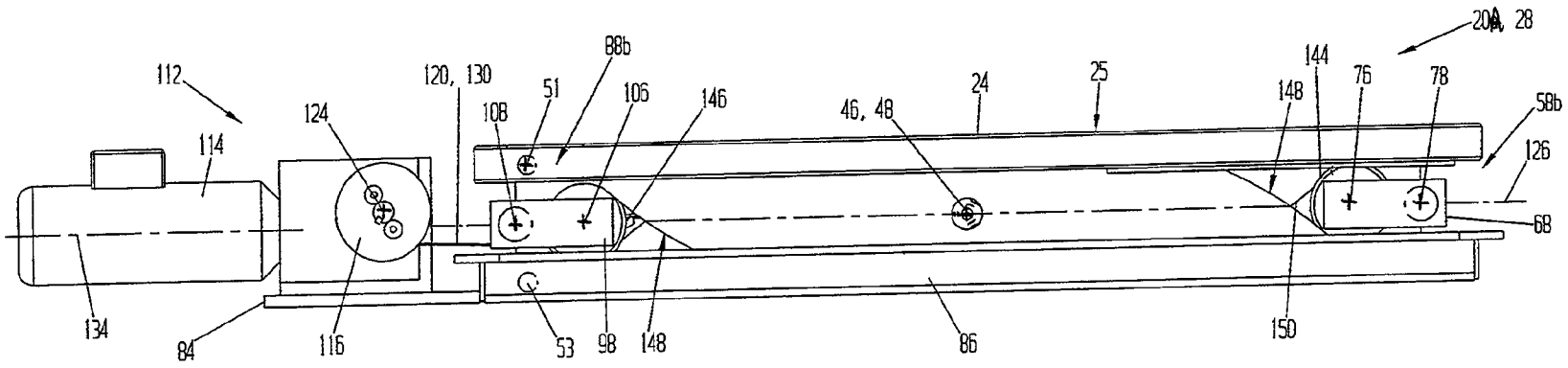
FIG. 8 is a side view of the lift assembly shown in FIG. 6 in a lowered state.
Figure 9:
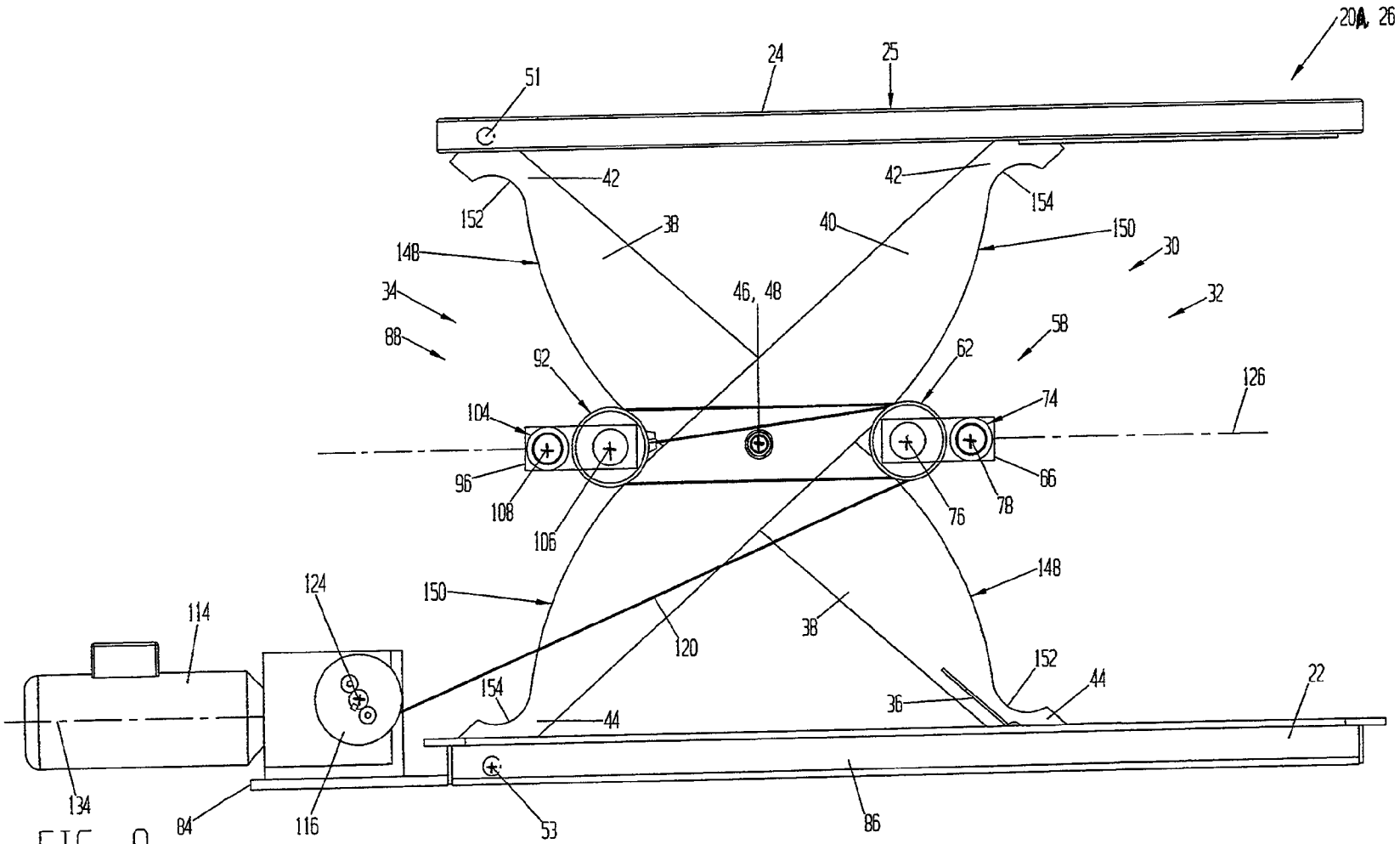
FIG. 9 is a side view of the lift assembly shown in FIG. 6 in an elevated state, with the second pair of scissor arms removed from view.

Returning to FIGS. 6-12, the cam surfaces 148 of the second embodiment of the scissor lift assembly 20A are each contoured near opposite ends 42, 44 of the first arms 38 to define the recesses 152. Similarly, the cam surfaces 150 are each contoured near opposite ends 42, 44 of the second arms 40 to define the recesses 154. In the lowered state 28 of lift assembly 20A, as shown in FIG. 8, the cam followers 140, 142, 144, 146 are received in spaces defined by the recesses 152 and 154 to minimize the total height of lift assembly 20A between the bottom most part of its base 22 and the load supporting surfaces 25 of the platform 24 in lowered state 28.

The first and second pulley arrangements 58 and 88 of the second embodiment of the lift assembly 20A, respectively, further include the shafts 72, 102, that are fixed to and extend in parallel with the shafts 64, 94 between the laterally spaced blocks or support members 66, 68 and 96, 98. The blocks 66, 68, 96, 98 are preferably structured and interconnected to maintain a consistent orientation of the axes 78 and 108 relative to the plane 126. They may, for example, both lie in the plane 126 as shown. Between the first and second pulley arrangements 58, 88, a pair of blocks (e.g. 66 and 96, or 68 and 98) may be linked together laterally outside the adjacent pair of scissor arms 32 or 34, for example.

Figure 13:
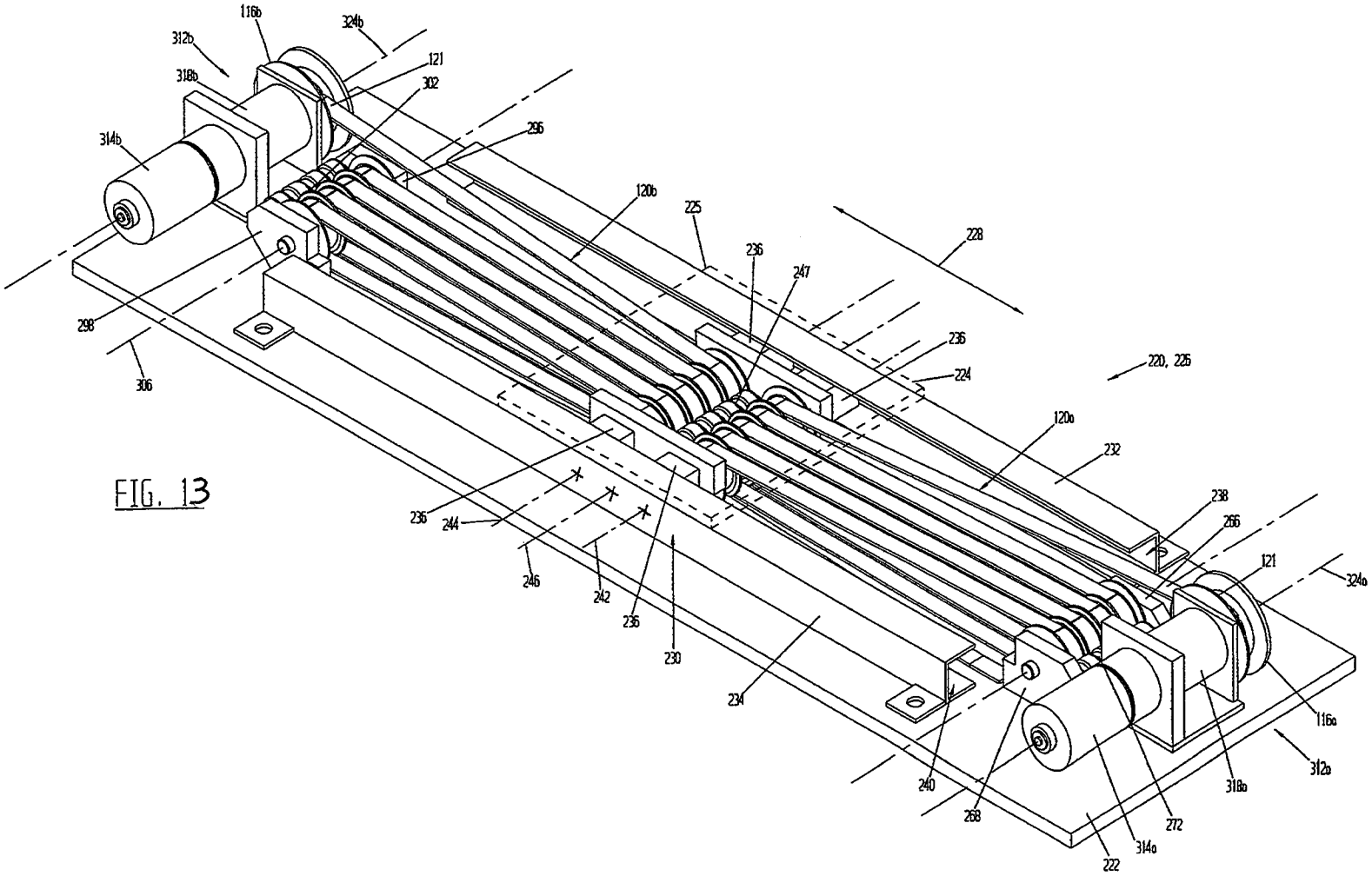
FIG. 13 is a perspective view of a conveyor or lift assembly according to a third embodiment, with its platform shown in phantom lines.
Figure 14:
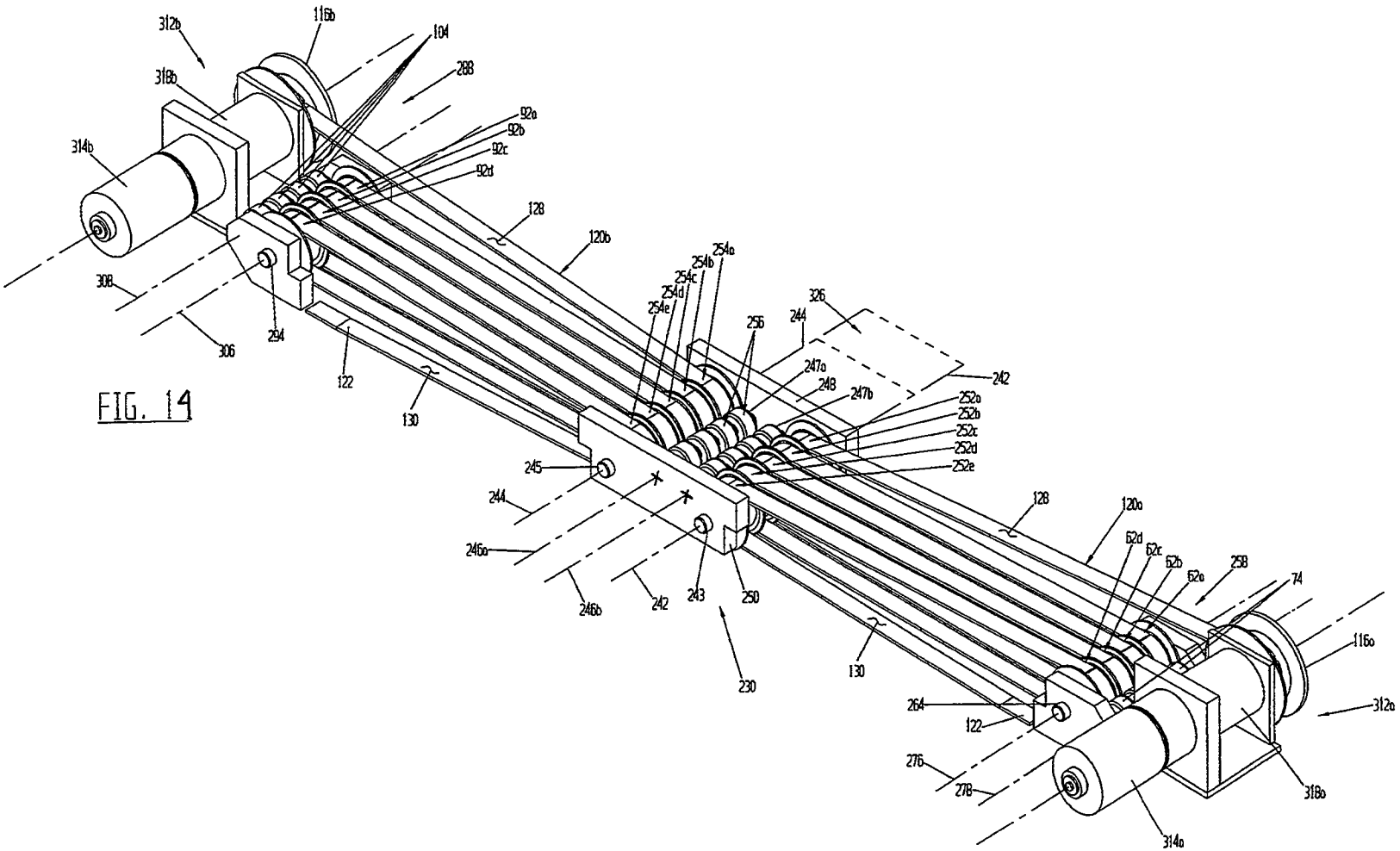
FIG. 14 is a perspective view of a variant of the conveyor or lift assembly shown in FIG. 13 with its platform, base and guide structure removed from view.

Referring now to FIGS. 13 and 14 there is shown a conveyor or lift assembly 220, a third embodiment of the present invention. Assembly 220 includes base 222, and as a conveyor assembly may also include platform 224 (shown in phantom lines in FIG. 13) defining support surface 225. Conveyor or lift assembly 220 has a centered state 226 and is arranged to provide conveying or lifting movement longitudinally in the directions indicated by double-headed arrow 228. A load supported by carriage 230 is thus moved longitudinally through operation of assembly 220. The load may be supported by platform 224 and moved substantially horizontally as a conveyor or, alternatively, a load supported by carriage 230 may be moved substantially vertically, as a lift or elevator.

Carriage 230, to which platform 224 may be attached, is disposed between a pair of longitudinally extending rails 232 and 234. Carriage 230 is provided with bearing elements 236 that are received in and supported by guide tracks 238, 240 of rails 232, 234. Bearing elements 236 support the load placed on surface 225 of platform 224 when assembly 220 is in a substantially horizontal orientation, or otherwise constrain the movement of carriage 230 away from base 222. Base 222, platform 224, and rails 232, 234 may be made of steel.

In FIGS. 13 and 14, the longitudinal direction is that indicated by arrow 228, the lateral direction being substantially perpendicular thereto in the directions of carriage pulley axis 242 defined by shaft 243, carriage pulley axis 244 defined by shaft 245, and carriage retainer roller axis 246 defined by shaft 247. Shafts 243, 245, and 247 extend between and are fixed to a pair of laterally spaced blocks 248, 250 to which bearings 236 are attached at the laterally outward sides thereof. Referring to FIG. 14, a variation of assembly 220 is shown that includes a pair of retainer roller axes 246*a* and 246*b* associated with a pair of shafts 247*a* and 247*b* extending between and fixed to blocks 248, 250, instead of the single shaft 247 and axis 246. Platform 224 may be attached to blocks 248, 250.

Respectively disposed about shafts 243 and 245 are like-numbered pluralities of independently rotatable carriage pulleys 252 and 254 which may be identical to above-discussed pulleys 62, 92. Disposed about shaft 247 (or about shafts 247*a* and 247*b*) are a plurality of retention rollers 256 which may be identical to above-discussed retention rollers 74, 104. Where a single shaft 247 carries retention rollers 256, there are a like number of retention rollers 256 and pairs of carriage pulleys 252 and 254, each retention roller disposed between and having a common relationship with each pair of carriage pulleys. In the variation shown in FIG. 13, there is a retention roller 256 associated with each one of carriage pulley 252, 254. The relationship between each pulley and its retention roller is as discussed above, and discussed further below.

Assembly 220 further includes first pulley arrangement 258, shown on the right side of FIGS. 13 and 14. First pulley arrangement 258 includes shaft 264 defining axis 276 about which is disposed a plurality of independently rotatable pulleys 62. Shaft 264 extends between and is fixed to a laterally spaced pair of blocks 266, 268 which are affixed to base 222. First pulley arrangement 258 further includes shaft 272 defining axis 278. Shaft 272 extends between and is fixed to blocks 266, 268, and is parallel to shaft 264. Disposed about shaft 272 is a plurality of independently rotatable retention rollers 74, one for each pulley 62.

Referring to the left side of FIGS. 13 and 14, assembly 220 further includes a second pulley arrangement 288 which is similar in configuration to first embodiment pulley assembly 258. Second pulley arrangement 288 includes shaft 294 defining axis 306 about which is disposed a plurality of independently rotatable pulleys 92, with shaft 294 extending between and fixed to laterally spaced blocks 296, 298 which are affixed to base 222. Second pulley arrangement 288 further includes shaft 302 defining axis 308. Shaft 302 extends between and is fixed to blocks 296, 298, and is parallel to shaft 294. Disposed about shaft 302 is a plurality of independently rotatable retention rollers 104, one for each pulley 92. Blocks 248, 250, 266, 266, 296, and 298 may be made of steel.

Extending between first pulley arrangement 258 and carriage 230 is first drive belt 120*a*, which is guided over a path defined by pulleys 62 and 252. As shown, there are four pulleys 62 in first pulley arrangement 258, identified as 62*a-d*, and five carriage pulleys 252, identified as carriage pulleys 252*a-e*. Elongate unitary belt 120*a* extends from about spool 116*a* leftwardly to carriage 230 where it is wrapped about carriage pulley 252*a*, and from pulley 252*a* belt 120*a* reverses course and at a slight return angle returns toward first pulley arrangement 258 where it is then wrapped about pulley 62*a*. From pulley 62*a* belt 120*a* reverses course and at a slight return angle returns toward carriage 230 where it is wrapped about pulley 252*b*. From pulley 252*b* belt 120*a* reverses course and at a slight return angle returns toward first pulley arrangement 258 where it is wrapped about pulley 62*b*. From pulley 62*b* belt 120*a* reverses course and at a slight return angle returns toward carriage 230 where it is wrapped about pulley 252*c*. From pulley 252*c* belt 120*a* reverses course and at a slight return angle returns toward first pulley arrangement 258 where it is wrapped about pulley 62*c*. From pulley 62*c* belt 120*a* reverses course and at a slight return angle returns toward carriage 230 where it is wrapped about pulley 252*d*. From pulley 252*d* belt 120*a* reverses course and at a slight return angle returns toward first pulley arrangement 258 where it is wrapped about pulley 62*d*. From pulley 62*d* belt 120*a* returns in a direction toward carriage 230 and wraps about pulley 252*e*, and reverses course returning toward first pulley arrangement 258 and its second end 122 is affixed to base 222. The return angle along which belt 120*a* extends between the carriage 230 and the first pulley arrangement 258 is relative to their parallel pulley axes 242, 276 and will vary slightly as carriage 230 moves longitudinally in the directions indicated by arrow 228, the return angle being at a maximum when carriage 230 is rightmost and being at a minimum when carriage 230 is leftmost, as viewed in FIGS. 13 and 14. The belt's ability to accommodate the return angles is facilitated in part by the belt engaging circumferential pulley surface 330 of pulleys 62 and 252 discussed further below in connection with FIG. 12.

Extending between second pulley arrangement 288 and carriage 230 is second drive belt 120*b*, which is guided over a path defined by pulleys 92 and 254. As shown, there are four pulleys 92 in second pulley arrangement 288, identified as 92*a-d*, and five carriage pulleys 254, identified as carriage pulleys 254*a-e*. Elongate unitary belt 120*b* extends from about spool 116*b* rightwardly to carriage 230 where it is wrapped about carriage pulley 254*a*, and from pulley 254*a* belt 120*b* reverses course and at a slight return angle returns toward second pulley arrangement 288 where it is then wrapped about pulley 92*a*. From pulley 92*a* belt 120*b* reverses course and at a slight return angle returns toward carriage 230 where it is wrapped about pulley 254*b*. From pulley 254*b* belt 120*b* reverses course and at a slight return angle returns toward second pulley arrangement 288 where it is wrapped about pulley 92*b*. From pulley 92*b* belt 120*b* reverses course and at a slight return angle returns toward carriage 230 where it is wrapped about pulley 254*c*. From pulley 254*c* belt 120*b* reverses course and at a slight return angle returns toward second pulley arrangement 288 where it is wrapped about pulley 92*c*. From pulley 92*c* belt 120*b* reverses course and at a slight return angle returns toward carriage 230 where it is wrapped about pulley 254*d*. From pulley 254*d* belt 120*b* reverses course and at a slight return angle returns toward second pulley arrangement 288 where it is wrapped about pulley 92*d*. From pulley 92*d* belt 120*b* returns in a direction toward carriage 230 and wraps about pulley 254*e*, and reverses course returning toward second pulley arrangement 288 and its second end 122 is affixed to base 222. The return angle along which belt 120*b* extends between the carriage 230 and the second pulley arrangement 288 is relative to their parallel pulley axes 244, 306 and will vary slightly as carriage 230 moves longitudinally in the directions indicated by arrow 228, the return angle being at a maximum when carriage 230 is leftmost and being at a minimum when carriage 230 is rightmost, as viewed in FIGS. 13 and 14. The belt's ability to accommodate the return angles is facilitated in part by the belt engaging circumferential pulley surface 330 of pulleys 92 and 254 discussed further below in connection with FIG. 12.

As described above, first end 121 of each belt 120 is attached to its respective spool 116 and is wound onto or unwound from the spool 116, which changes the length of the path over which the belt 120 extends, the path being defined by the respective pulleys over which it is wrapped. The second end 122 of each belt 120 is affixed to base 222 adjacent the respective first or second pulley arrangement.

Assembly 220 includes a first motor drive assembly 312*a* which is arranged for pulling belt 120*a* rightward through rotation of its motor 314*a* which may be rotatable in only a single direction. As shown, the direction of rotation of motor 314*a* of motor drive assembly 312*a* when pulling carriage 230 rightwardly as belt 120*a* is wound onto spool 116*a*, is clockwise. In motor drive assembly 312*a*, the output shaft of motor 314*a* may extend through a clutch housing 318*a* that includes a one way clutch which allows belt 120*a* to be unwound from spool 116*a* as carriage 230 is pulled leftwardly by second motor drive assembly 312*b* when motor 314*a* is de-energized.

Similarly, second motor drive 312*b* of assembly 220 is arranged for pulling belt 120*b* leftwardly through rotation of its motor 314*b* which may be rotatable in only a single direction. As shown, the direction of rotation of motor 314*b* of motor drive assembly 312*b* when pulling carriage 230 leftwardly as belt 120*b* is wound onto spool 116*b*, is counterclockwise. In motor drive assembly 312*b*, the output shaft of motor 314*b* may extend through a clutch housing 318*b* that includes a one way clutch which allows belt 120*b* to be unwound from spool 116*b* as carriage 230 is pulled rightwardly by first motor drive assembly 312*a* when motor 314*b* is de-energized.

One of ordinary skill in the art will recognize that motor drive assemblies 312*a* and 312*b* are individually and exclusively energized to move a load supported by carriage 230 in one of the two directions indicated by arrow 228. Movement of carriage 230 rightward as shown in FIGS. 13 and 14, for example, involves energizing motor drive assembly 312*a* which will wind belt 120*a* onto spool 116*a*, shortening the path over which it extends over pulleys 62 and 252, thus moving axis 242 towards axis 276. Axes 242 and 276 can, of course, define a plane in which the axes can move laterally toward and away from each other. As carriage 230 is moved leftward as belt 120*b* is wound onto spool 116*b*, belt 120*a* is unwound from about spool 116*a* of motor drive assembly 312*a* as the clutch in clutch housing 318*a* allows relative rotation between spool 116*a* and motor 314*a*, thereby lengthening the path over which belt 120*a* extends over pulleys 62 and 252.

Referring now again to FIG. 12, the relationship between each pulley 62, 92, 252, or 254 and its associated retention roller 74, 104, or 256 is discussed in further detail. There is a gap between the circumferential surface 330 of the pulley and a circumferential surface 332 of the retention roller through which the belt 120 is fed. The retention roller 74, 104, 256 prevents the belt 120 from becoming disengaged from the pulley 62, 92, 252, 254 during installation and operation of the lift or conveyor assembly 20, 20A, 220. Notably, the proximity of the circumferential surfaces 330, 332 of the pulley 62, 92, 252, 254 and retention roller 74, 104, 256 is such that the gap therebetween is sufficient to allow a space between the outer surface 128 of the belt 120 and the surface 332 of the retention roller 74, 104, 256. As discussed above, preferably, the retention roller 74, 104, 256 extends partially between the opposed flange members 70, 100, thereby creating a closed gap and assisting in capturing the belt 120, 120*a*, 120*b* between the flange members 70, 100. Further, as readily understood from the above description, the reversing path of a belt 120, 120*a*, 120*b* over a series of any plurality of pulleys causes the belt to be directed at different return angles on the top and bottom sides of the pulleys. Although the belt may angle slightly between the pulleys along the path, the configuration of the flange members and retention rollers allows the circumferential surface 330 of the pulleys to be relatively flat, as opposed to a more expensive crowned or barrel-shaped configuration. In other words, each of the first pulleys 62 includes a belt engaging circumferential surface 330 that is substantially flat, and each of the second pulleys 92 similarly includes a belt engaging circumferential surface 330 that is substantially flat.

As to a further discussion of the manner of usage and operation of the present invention, the same should be apparent from the above description. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A scissors-type lift assembly comprising:

a base;

a platform coupled to said base for movement between elevated and lowered states in which said platform and said base are distant and proximate, respectively;

a pair of first and second scissor arms each having upper and lower ends respectively coupled to said platform and said base, said pair of scissor arms pivotably connected to each other intermediate their respective upper and lower ends about a central pivot axis;

a first pulley arrangement having a plurality of first pulleys disposed about a first pulley shaft defining a first pulley axis with each of said first pulleys having a first belt engaging circumferential surface that is substantially flat;

a second pulley arrangement having a plurality of second pulleys disposed about a second pulley shaft defining a second pulley axis with each of said second pulleys having a second belt engaging circumferential surface that is substantially flat, and said first and second pulley axes disposed in a pulley plane and having lateral movement relative to each other as said lift assembly is moved between its said elevated and lowered states;

a spool rotatable about an axis fixed to said base; and a unitary belt guided through a path defined by said first and second pulleys with said belt having a first end engaged with said spool onto which said belt is wound and from which said belt is unwound and an opposing second end;

said first pulley arrangement further including a plurality of independently rotatable first flange members disposed about said first pulley shaft with each of said first flange members extending outwardly beyond said first belt engaging circumferential surfaces of said first pulleys, and at least one of said first flange members disposed between each of said first pulleys to sandwich said respective first pulleys and to maintain said belt on said path and said first belt engaging circumferential surfaces about said respective first pulleys; and said second pulley arrangement further including a plurality of independently rotatable second flange members disposed about said second pulley shaft with each of said second flange members extending outwardly beyond said second belt engaging circumferential surfaces of said second pulleys, and at least one of said second flange members disposed between each of said second pulleys to sandwich said respective second pulleys and to maintain said belt on said path and said second belt engaging circumferential surfaces about said respective second pulleys.

2. The scissors-type lift assembly as set forth in claim 1 wherein said first and second flange members have an annular washer-like configuration.

3. The scissors-type lift assembly as set forth in claim 2 wherein said first and second flange members include smooth outer surfaces.

4. The scissors-type lift assembly as set forth in claim 1 wherein said first flange members are independently rotatable relative to said first pulleys and each other, and wherein said second flange members are independently rotatable relative to said second pulleys and each other.

5. The scissors-type lift assembly as set forth in claim 1 further including a lateral guide mounted between said first and second pulley shafts to maintain said pulley plane and to guide said lateral movement of said first and second pulley arrangements relative to each other.

6. The scissors-type lift assembly as set forth in claim 5 wherein said second pulley shaft is fixedly mounted to said lateral guide and said first pulley shaft is slidably disposed about said lateral guide.

7. The scissors-type lift assembly as set forth in claim 6 wherein said first pulley shaft includes a collar slideably engaging said lateral guide.

8. The scissors-type lift assembly as set forth in claim 1 wherein said unitary belt is further defined as a first drive belt and further including a second drive belt to define a dual-belt configuration.

9. The scissors-type lift assembly as set forth in claim 8 wherein said first plurality of pulleys includes two groups of first pulleys spaced from each other with one of said groups supporting said first drive belt and the other of said group supporting said second drive belt.

10. The scissors-type lift assembly as set forth in claim 9 wherein said first pulley shaft includes a first spacer separating said groups of said first pulleys.

11. The scissors-type lift assembly as set forth in claim 8 wherein said second plurality of pulleys includes two groups of second pulleys spaced from each other with one of said groups supporting said first drive belt and the other of said group supporting said second drive belt.

12. The scissors-type lift assembly as set forth in claim 11 wherein said second pulley shaft includes a second spacer separating said groups of said second pulleys.

13. The scissors-type lift assembly as set forth in claim 1 wherein said upper and lower ends of said first and second scissor arms each include a recess, and wherein each of said first and second scissor arms includes a cam surface extending from said central pivot axis and terminating at respective recesses.

14. The scissors-type lift assembly as set forth in claim 13 further including a first cam follower disposed at each distal end of said first pulley shaft with said first cam follower engaging said cam surfaces during said movement of said lift assembly and engaging said recesses when in said lowered state.

15. The scissors-type lift assembly as set forth in claim 13 further including a second cam follower disposed at each distal end of said second pulley shaft with said second cam follower engaging said cam surfaces during said movement of said lift assembly and engaging said recesses when in said lowered state.

16. The scissors-type lift assembly as set forth in claim 1 further including a plurality of first retention rollers each having a circumferential surface disposed in proximity to a respective circumferential surface of said first pulleys and adjacent a respective portion of said belt for maintaining a position of said belt on said circumferential surface of said first pulleys.

17. The scissors-type lift assembly as set forth in claim 16 further including a first roller shaft mounted near said first pulley shaft with said first retention rollers rotatably supported on said first roller shaft.

18. The scissors-type lift assembly as set forth in claim 16 wherein each of said first retention rollers are retained axially along said first roller shaft by respective first flange members.

19. The scissors-type lift assembly as set forth in claim 1 further including a plurality of second retention rollers each having a circumferential surface disposed in proximity to a respective circumferential surface of said second pulleys and adjacent a respective portion of said belt for maintaining a position of said belt on said circumferential surface of said second pulleys.

20. The scissors-type lift assembly as set forth in claim 19 further including a second roller shaft mounted near said second pulley shaft with said second retention rollers rotatably supported on said second roller shaft.

21. The scissors-type lift assembly as set forth in claim 19 wherein each of said second retention rollers are retained axially along said second roller shaft by respective second flange members.

* * * * *